United States Patent [19]
Janssen et al.
[11] 4,424,734
[45] Jan. 10, 1984

[54] PROTECTING COVER FOR A GUN BARREL

[75] Inventors: Karl-Egon Janssen, Meerbusch; Heinz-Guenter Breuer, Duisburg, both of Fed. Rep. of Germany

[73] Assignee: Heinmetall GmbH., Duesseldorf, Fed. Rep. of Germany

[21] Appl. No.: 223,945

[22] Filed: Jan. 12, 1981

[30] Foreign Application Priority Data

Feb. 12, 1980 [DE] Fed. Rep. of Germany ..... 3005117

[51] Int. Cl.³ ..... F41F 17/08
[52] U.S. Cl. ..... 89/16
[58] Field of Search ..... 42/76 A; 89/14.1, 16, 89/36 R

[56] References Cited

U.S. PATENT DOCUMENTS 664,848 1/1901 Glover ..... 89/16

FOREIGN PATENT DOCUMENTS 1918422 10/1970 Fed. Rep. of Germany .

*Primary Examiner*—Stephen C. Bentley

[57] ABSTRACT

A pipe-shaped protective cover for a gun barrel mounted over at least a portion of the outer periphery of the gun barrel. The protective cover includes a first-insulating layer joined to the outer surface of the gun barrel; a second heat-conducting layer mounted on said first layer; and at least one additional heat-insulating layer followed by at least one additional heat conducting layer which are mounted in that order on the second aforementioned layer. The invention envisages a firm mounting of the protective cover on the gun barrel without the formation of intermediate air gaps between the cover and the gun barrel.

11 Claims, 4 Drawing Figures

PROTECTING COVER FOR A GUN BARREL

BACKGROUND OF THE INVENTION

The invention relates to a protective cover for a gun barrel which is arranged over at least a portion of the outer surface of the gun barrel in the form of a cylindrical jacket coaxially mounted thereon. Insulating covers of this type made out of asbestos or other textile material or also made out of a metal pipe are usually mounted over the gun barrel in spaced relationship thereto. Such covers are known and are, for example, described in German published and examined application DE-AS No. 1918422.

Such known covers are designed to protect the gun barrel against the effects of pollution and other external effects producing wear, such as wind, the sun or rain, etc., as well as to avoid the effects of non-uniform temperature changes which occur in the gun barrel during firing. With these known covers there cannot be avoided, the formation of an airgap between the insulating cover and the gun barrel in view of their construction, and this is in some cases even an intended design feature thereof. The air layer in the air gap causes, during the firing, a heat exchange effect on the gun barrel surface and leads to temperature difference in the gun barrel wall over the gun barrel periphery, which in turn leads to a gun barrel distortion and consequently to a lowering of firing and target impact accuracy. The temperature differences in these known installations can be only poorly equalized in the gun barrel coverings or not at all.

SUMMARY OF THE INVENTION

It is the object of this invention to provide a covering which avoids or mitigates the afore-described drawbacks and which is resistant to the wear produced by firing and which protects the gun barrel over its entire outer surface against temperature differentials as well as against influences of the weather, pollution as well as the high temperature effects produced during firing. In particular the cover of the invention provides a joining of the gun barrel and its cover which is free of airgaps.

In accordance with the invention, the cover includes a protective layer having no intermediate air space which is firmly mounted on the exterior gun barrel wall surface and which, starting with the gun barrel outer wall, has a first heat insulating layer, a first heat conducting layer on which there are at least mounted a further heat insulating layer and a further heat conducting layer. Due to this sequence of layers there is effected, on the one hand, a radial insulating against externally acting polluting influences and, on the other hand, a tangential heat conduction and thereby a compensation of still present temperature differentials on the gun barrel periphery. Thereby a heat exchange is avoided.

A further object of this invention is, that when the cover is damaged, it can be easily and inexpensively repaired. Accordingly the cover can, therefore, be constructed in such a way, that both of the first afore-described inner layers form an inner cover which is securely affixed to the gun barrel outer wall surface of the weapon and the further layers form an exterior cover which is slidably exchangeably mounted on the inner cover. By constructing the outer wall of the inner cover and the inner wall of the outer cover in mutually mating fashion, and by utilizing an elastic insulating material there is provided a secure joining of the fixably mounted inner cover and the loosely mounted outer cover forming the composite protective cover.

A particularly advantageous joining of the cover with the gun barrel is achieved, in accordance with the invention, not withstanding the high accelaration forces to which the barrel is subjected during firing, by making the first heat insulating layer out of one or more, preferably two, layers of loose ceramic fibers which are affixed to the gun barrel outer wall surfaces by means of a glueing material. A heat-resistant hose of synthetic material is slid over this first coating and is then shrunk due to the influence of heat energy changes. The shrinking hose of synthetic material serves to facilitate the mounting and increases the stability of the inner cover. To achieve the necessary glueing of the ceramic fibers, that is for facilitating the application of the glueing material, there is preferably used a single component of cementatious glueing material. As a suitable synthetic material for the shrinking of the synthetic material hose there is selected a polytetrafluor ethylene material. The synthetic hose can be etched on its inner surface and/or its outer surface, so that, as a result of a roughening of the surface, a better joining with the adjoining layer is achieved.

As first heat conducting layer, there can be utilized an aluminum pipe which can be slid over the first heat insulating layer, which is conically shaped on its exterior, and on which the exchangeable outer cover can be easily slid. The silicone foam layer is formed after the conically shaped pipe has been slid onto the first insulating layer, thereby a two component-silicone-foam mass is pumped into the hollow space in liquid form, and forms therein a closed-porous foam layer. Thereby the air is expelled from the hollow space. In order to achieve this, there are provided during the production suitable air exit openings.

In accordance with an alternate embodiment of the invention, the first heat conducting layer can be formed in the region of a conically shaped part of the gun barrel, on the first heat insulating layer by winding thereon an aluminum wire, preferably in pre-stressed condition, the surface of which is covered with shrinking hose made of a glue or other temperature-resistant synthetic material. Since the gun barrel is conically shaped in this region, the surface formed by the glued together covering aluminum wire is also conically shaped. The glueing material, respectively the synthetic material-shrinking-hose, prevents, in the event of damage to the exterior cover, a springing up and/or releasing of the wound wire of the inner cover, so that an exchange of the exterior cover may be carried out. This embodiment is preferably used in the region of the gun barrel muzzle.

As second heat conducting layer there is preferably used a cylindrical aluminum pipe with a conically shaped inner wall cladding made out of silicone foam which constitutes the second heat insulating layer. A conicality of the inner wall cladding mates with the conicality of the aluminum pipe respectively the aluminum wire structure or that of the synthetic material shrinking hose of the first heat conducting layer. Thereby a form locking joining the inner and outer cover is achieved. The inner wall cladding or lining of the cylindrical pipe is carried out by an auxiliar arrangement prior to the sliding over onto the conically shaped pipe.

The cover can extend over the entire gun barrel length or can be divided into a plurality of parts along its longitudinal direction. The securing of the exchangeable exterior cover of the composite covering can be achieved by means of adjustable rings as long as there are not already in view of constructional considerations, pipes being affixed on the surface of the gun barrel. Preferably spacing is effected by the cover between the rear part between the gun barrel guide bushing and the smoke suction remover and a forward part between the smoke suction remover and the gun barrel muzzle. A particularly favorable mounting of the cover onto the gun barrel is achieved by mounting, on the one hand, the conically shaped aluminum pipe against a ring surface of the gun barrel guide bushing or against a preferably threadably adjustable ring mounted in front of it, and on the other hand, against a ring surface of the smoke removing suction device. A bracing of the inner cover is not necessary, since it is firmly mounted on the gun barrel, for example by means of the elastic synthetic material shrinking hose or the pre-stressed wire structures.

BRIEF DESCRIPTION OF THE DRAWING

The above objects, features and advantages of the instant invention along with other objects, features and advantages will become apparent upon reading of the following description of two preferred embodiments of the instant invention in conjunction with the drawing as follows.

DETAILED DESCRIPTION

Figure 1:
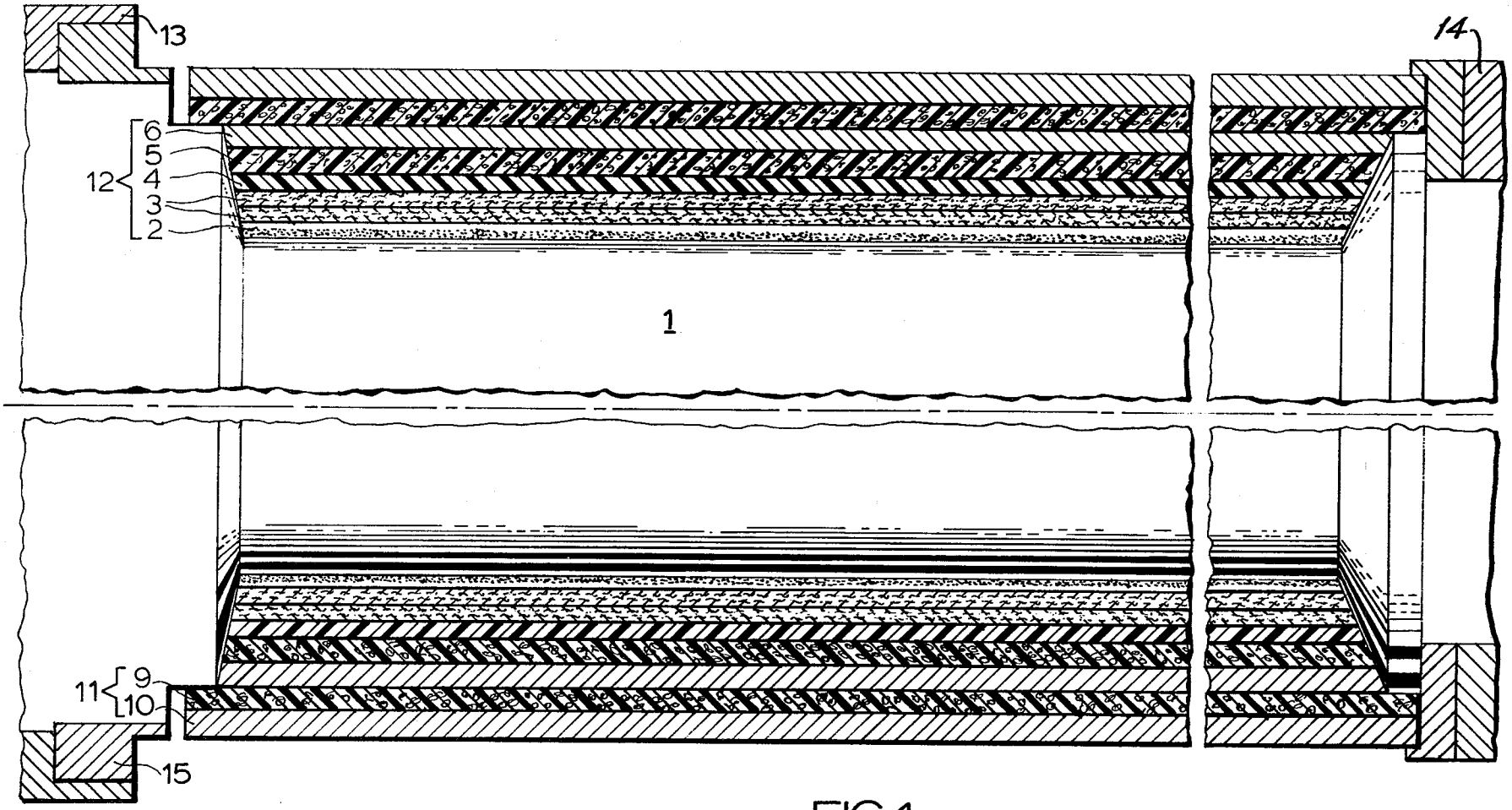
FIG. 1 is a longitudinal fragmented sectional view of a portion of a gun barrel in the rear region thereof.
Figure 2:
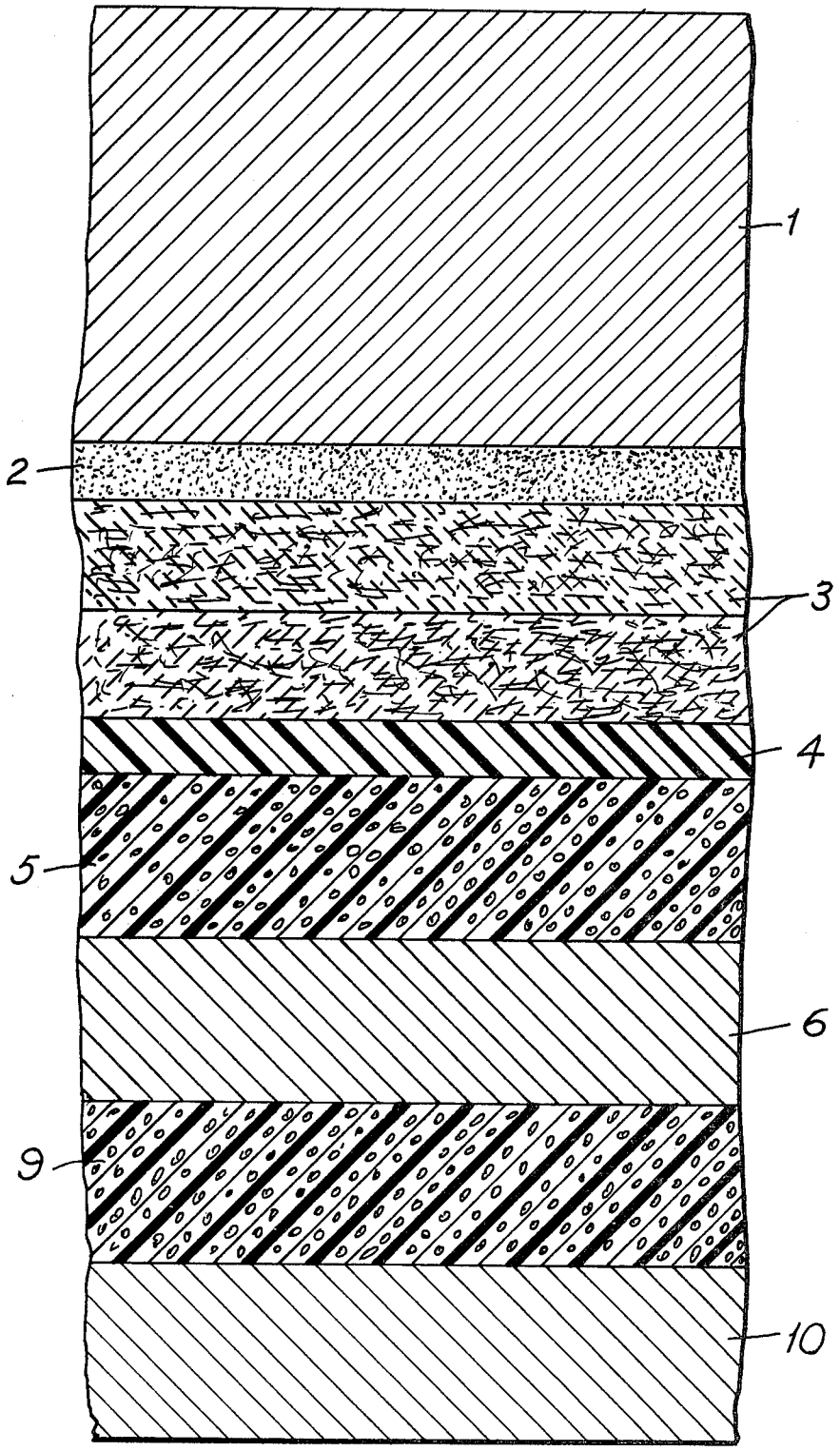
FIG. 2 is a partial sectional schematic view of a portion of the gun barrel wall of the gun barrel illustrated in FIG. 1 in an enlarged scale.

In the gun barrel illustrated in FIGS. 1 and 2, there is mounted on the exterior wall of the gun barrel 1 with the aid of glueing material 2 two layers of ceramic fibers 3. Over the two layers 3 there is mounted the shrinking hose 4. Over the latter there is mounted a silicone foam layer 5 and over the latter the conically shaped aluminum pipe 6. Over the latter there is mounted the silicone foam layer 9, which is firmly secured to the outer cylindrical aluminum pipe 10. There is disposed between the aluminum pipe 6 and the foam layer 9 a disconnecting point between the inner and outer cover. FIG. 1 illustrates the outwardly conically shaped inner cover 12 and the outer cover 11, formed by the layers 9 and 10, which is inwardly conically shaped and which is disposed between a screwable ring 15 of the gun barrel guide bushing 13 and the smoke suction removing device 14.

Figure 3:
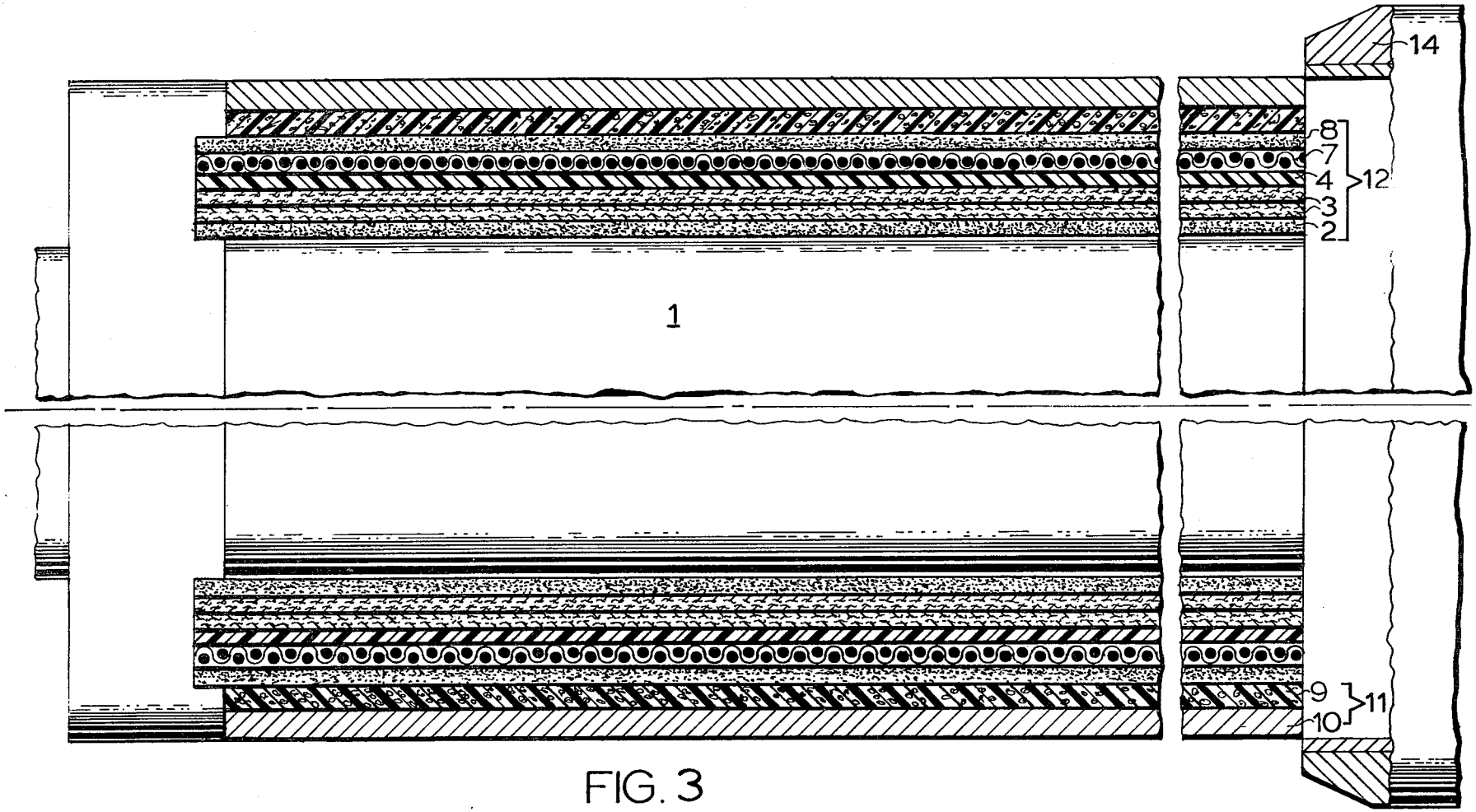
FIG. 3 is a longitudinal fragmented sectional view of a portion of the gun barrel in the front region thereof.
Figure 4:
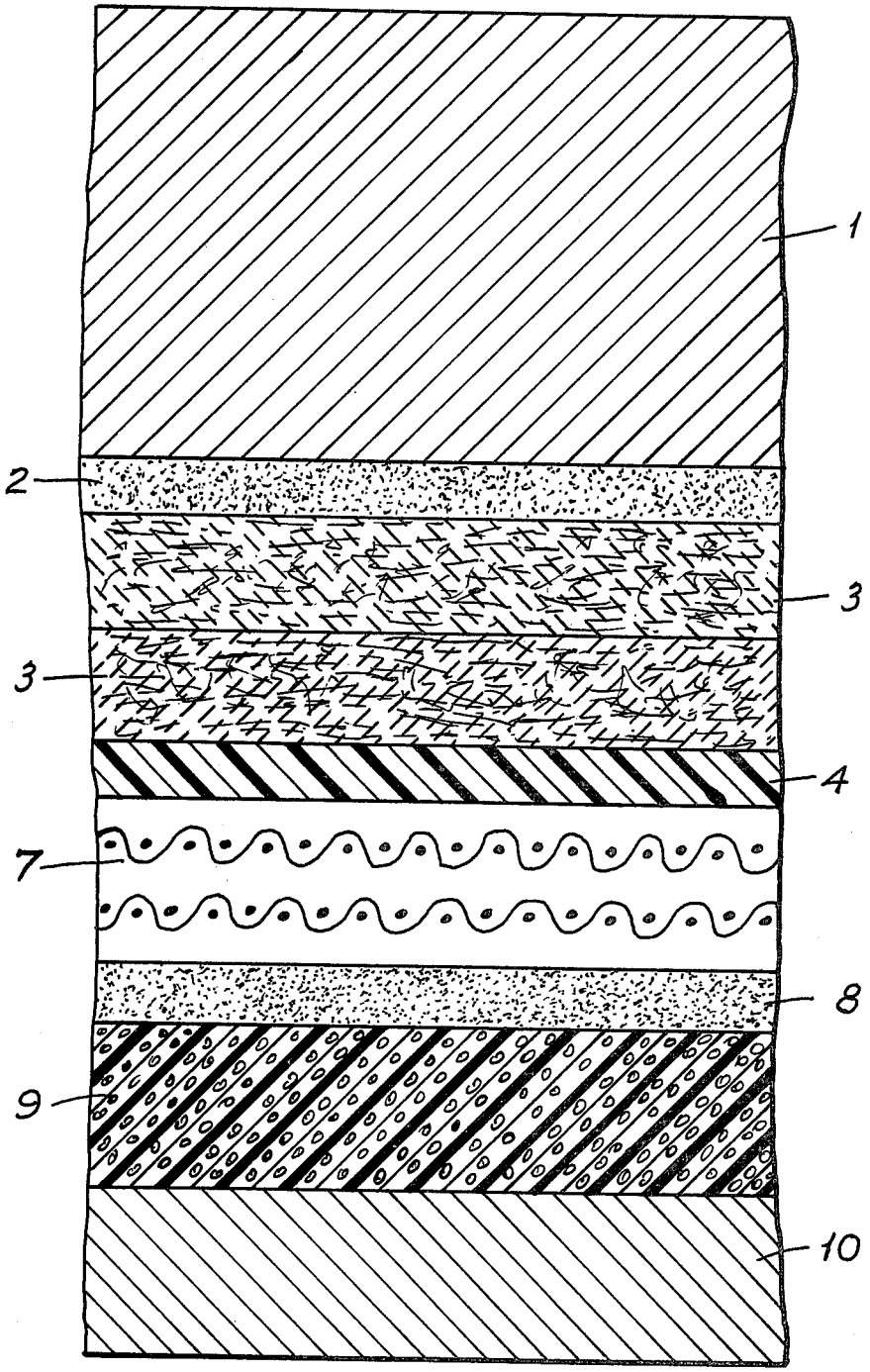
FIG. 4 is a partial sectional schematic view at an enlarged scale of a portion of the gun barrel wall of the gun barrel illustrated in FIG. 3.

In the alternate embodiment in accordance with FIGS. 3 and 4, there is provided in lieu of the silicone foam layer 5 and the conically shaped pipe 6 the conically shaped construction formed by the wound wire 7, which presents an outer smooth surface in view of a glue substance 8 applied thereto.

In lieu of the illustrated wire having a round cross section other types of wires with different cross sections can be used. For example, a wound wire having a square cross section, has been found suitable whereby air gap spaces are even more thoroughly avoided.

It is essential for the invention that the new cover can participate in the "breathing" of the gun barrel during firing and can resist the acceleration forces which occur during firing. For this purpose the layer which is directly applied to the gun barrel must be made out of loose material having a low specific gravity, which is elastically held about the gun barrel by means of the hose made of synthetic material. Such an elastic mounting is also achieved by means of the prestressed wound wire which serves as the first heat conducting layer.

Of further importance for the invention is that the formation of air pockets is avoided between all layers. Thereby the penetration of asymmetrical heat currents in the cover and up to the gun barrel are avoided. Despite the heat-insulation of the asymmetrical heat currents, which penetrate into cover are distributed on the periphery in a resistance-poor fashion.

Although the invention is illustrated and described with reference to a plurality of embodiments thereof, it is to be expressly understood that it is in no way limited to the disclosure of such preferred embodiments, but is capable of numerous modifications within the scope of the appended claims.

We claim:

1. A pipe-shaped composite protective cover to a gun barrel mounted over the outer periphery of the gun barrel, comprising in combination, a first heat-insulating layer consisting of loose material having a low specific gravity which first layer is elastically supported around the outer surface of the gun barrel;

a second heat-conducting layer firmly mounted on said first layer by means of a foamed on layer of silicone foam mounted on said first layer; and at least one additional heat-insulating layer followed by at least one additional heat-conducting layer mounted in that order on said second layer;

said protective cover being firmly mounted on said gun barrel without intermediate air gaps between the cover and the gun barrel surface.

2. The pipe-shaped protective cover for a gun barrel as set forth in claim 1, wherein the first and second layer form an inner lining directly mounted on the gun barrel surface, and the additional layers form a slidably exchangeable outer lining.

3. The pipe-shaped protective cover for a gun barrel as set forth in claim 2, wherein said first heat-insulating layer comprises at least two layers of ceramic fibers respectively affixed to the gun barrel and the underlying layer by a glueing substance, and a temperature-resistant hose mounted on the outer one of the ceramic fiber layes, said hose being made of synthetic material and being slid over said outer ceramic fiber layer and being thereafter shrunk by means of a heat treatment.

4. The pipe-shaped protective cover for a gun barrel as set forth in claim 3, wherein said second heat-conducting layer is made of an aluminum outwardly conically shaped pipe which is joined to the first heat-insulating layer by means of a silicone foam layer in an air-gap-free manner.

5. The pipe-shaped protective cover for a gun barrel as set forth in claim 3, wherein said gun barrel has an outwardly conically shaped region on which the first heat-insulating layer is mounted, an aluminum wire is wound on the first layer and forms the second heat-conducting layer, and a glueing substance covers the surface of the second layer formed by the wound aluminum wire.

6. The pipe-shaped protective cover for a gun barrel as set forth in claim 5, wherein in lieu of the glueing substance the second layer is covered by a temperature-resistant hose of synthetic material adapted to shrink when subjected to a heat treatment.

7. The pipe-shaped protective cover for a gun barrel as set forth in claim 5, wherein said wound aluminum wire is pre-stressed.

8. The pipe-shaped protective cover for a gun barrel as set forth in claim 5, wherein a further heat-conducting layer is formed, in addition to the second heat conducting layer, by an aluminum pipe having an internal conical shape and having its inner surface covered by a lining of silicon foam forming a further heat-insulating layer in addition to said first heat insulating layer, whereby the internal conicality of said silicon foam lining mates with external conicality of said second layer.

9. The pipe-shaped protective cover for a gun barrel as set forth in claim 6, wherein said protective cover has two parts and said gun barrel has a gun barrel bushing at one end, a muzzle at the other end and a smoke suction device disposed therebetween, a first part of said cover being disposed between said bushing and suction device and a second part of said cover being disposed between said suction device and said bushing.

10. The pipe-shaped protective cover for a gun barrel as set forth in claim 9, wherein said second part of said cover has one end thereof abutting against said bushing and an other part abutting against said section device.

11. The pipe-shape protective cover for a gun barrel as set forth in claim 1, a second heat-conducting layer in the form of a wound on aluminum wire the surface of which is covered with a glueing substance or a synthetic base and which is firmly mounted on said first heat insulating layer by being pre-stressed.

* * * * *